US007976178B2

(12) United States Patent
Esses

(10) Patent No.: US 7,976,178 B2
(45) **Date of Patent: *Jul. 12, 2011**

(54) MOTION-RESPONSIVE ILLUMINATED STOCKING

(75) Inventor: Ezra Esses, Brooklyn, NY (US)

(73) Assignee: E. S. Originals, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/648,757

(22) Filed: Dec. 29, 2009

(65) Prior Publication Data

US 2010/0097788 A1 Apr. 22, 2010

Related U.S. Application Data

(63) Continuation of application No. 11/894,852, filed on Aug. 22, 2007, now abandoned, which is a continuation of application No. 11/156,858, filed on Jun. 20, 2005, now Pat. No. 7,267,452.

(51) Int. Cl.
*F21V 21/08* (2006.01)

(52) U.S. Cl. ..... 362/103; 362/276

(58) Field of Classification Search ..... 362/103, 362/276, 570, 234, 235, 267, 411, 802; 36/137; 2/239

See application file for complete search history.

(56) References Cited

U.S. PATENT DOCUMENTS 4,774,434 A 9/1988 Bennion
4,848,009 A 7/1989 Rodgers
5,375,044 A 12/1994 Guritz
5,465,197 A 11/1995 Chien
5,523,741 A 6/1996 Cane
5,577,828 A 11/1996 Nadel et al.
5,622,422 A 4/1997 Rodgers
5,649,755 A 7/1997 Rapisarda
5,688,038 A 11/1997 Chien
5,876,108 A 3/1999 Chien
5,882,110 A 3/1999 Rapisarda
5,947,580 A 9/1999 Chien
5,969,479 A 10/1999 Wong
6,012,822 A 1/2000 Robinson
6,023,516 A 2/2000 Rifkind
6,065,851 A 5/2000 So
6,104,140 A 8/2000 Wut
6,481,868 B1 11/2002 Lin
6,619,812 B2 9/2003 Rapisarda
7,147,337 B1 12/2006 Rapisarda
7,267,452 B2 * 9/2007 Esses ..... 362/103
7,278,758 B2 10/2007 Esses
7,347,577 B1 3/2008 Rapisarda
2003/0174496 A1 9/2003 Wong
2004/0251837 A1 12/2004 Leung et al.
2006/0082987 A1 4/2006 Dorsey
2007/0159808 A1 7/2007 Chen

OTHER PUBLICATIONS

U.S. Reexam Appl. No. 95/000,329, Re: U.S. Patent No. 7,278,758, Notice of Intent to Issue Inter Partes Reexamination Certificate, Sep. 15, 2009.

Master Bond Polymer System UV15x-2 Product Description, www.masterbond.com/tds/uv15x-2.html. downloaded on Dec. 4, 2007, Master Bond Inc., 1999-2007.

(Continued)

*Primary Examiner* — Bao Q Truong
(74) *Attorney, Agent, or Firm* — Kirschstein, et al.

(57) ABSTRACT

A stocking is illuminated with flashing lights in response to movement by a wearer and is protected against water damage.

19 Claims, 2 Drawing Sheets

OTHER PUBLICATIONS

Beware of men wearing brogues, www.Telegraph.co.uk, downloaded on Dec. 6, 2007, last updated Jun. 24, 2003, Telegraph Media Group Limited.

Carlo Rotella, Someone Else's Chicago, www.washingtonpost.com, Mar. 7, 2004, The Washington Post Company, 2005.

Fred A. Bernstein, Art/Architecture; The Conceptual Prep School: Library as Light Show, www.nytimes.com, Jul. 13, 2003, The New York Times Company, 2007.

Elizabeth Sawin, If the Shoe Doesn't Fit a back-to-school lesson in consumption, www.grist.org/commnets/citizen/2002/09/05/shoe/index.html, Sep. 5, 2002, Grist Magazine, Inc. 2007.

Lisa Guernsey, News Watch; Techie Sneakers That Measure a Child's personal Best, www.nytimes.com, Nov. 18, 1999, The New York Times Company, 2007.

Henry Fountain, Inside the Flashy Shoe That Encourages Children to Step on it, www.nytimes.com, Oct. 7, 1999, The New York Times Company, 2007.

* cited by examiner

MOTION-RESPONSIVE ILLUMINATED STOCKING

CROSS REFERENCE TO RELATED APPLICATIONS

This is a continuation of U.S. patent application Ser. No. 11/894,852, filed Aug. 22, 2007, now abandoned, which, in turn, is a continuation of U.S. patent application Ser. No. 11/156,858, filed Jun. 20, 2005, now U.S. Pat. No. 7,267,452.

BACKGROUND OF THE INVENTION

1. Field of the Invention

The present invention generally relates to hosiery and, more particularly, to a stocking which is illuminated in response to motion by a wearer.

2. Description of the Related Art

Stockings are, of course, worn by men, women and children, typically for reasons of comfort, hygiene, and fashion when shoes are worn over the stockings. Also, stockings are often worn instead of shoes, especially indoors. As advantageous as the known stockings have been, improvements can still be made in their use, particularly for providing a more visually stimulating appearance and for enhancing their safe use.

SUMMARY OF THE INVENTION

Objects of the Invention

Accordingly, it is a general object of this invention to improve the state of hosiery.

More particularly, it is an object of the present invention to provide a visually stimulating, eye-catching display on hosiery.

Still another object of the present invention is to promote safety when wearing the hosiery.

FEATURES OF THE INVENTION

In keeping with the above objects and others which will become apparent hereinafter, one feature of the present invention resides, briefly stated, in a motion-responsive illuminated stocking comprising a covering, preferably constituted of knitted yarn, having a foot portion closely fitted on a wearer's foot, and a leg portion closely fitted on a part of the wearer's leg, especially at the ankle. An open end portion of the covering is foldable to form an annular cuff.

The stocking includes a lighting module for emitting light in response to motion by the wearer. The module includes a battery, at least one light source and preferably a plurality of light sources, a processor, and a motion-responsive switch for connecting the battery to the processor and to the light sources to cause the latter to flash light in accordance with a pattern determined by the processor.

An overlay is attached to the covering, preferably at the cuff. The overlay bounds with the covering a compartment in which the module is received and held. The overlay is transmissive to the light flashed by the light sources. Preferably, a graphic is provided on the overlay.

Means are provided for resisting entry of water to the module. The water may come from a variety of sources, for example, as moisture evaporating from the wearer's body, as rain, or as wash water used during laundering of the stocking. Such water can cause failure of the lights to flash. To resist such failure, the resisting means includes a heat-fused seal extending around a periphery of the overlay and sealing the overlay to the cuff and/or a sealed envelope in which the module is sealingly contained and/or a synthetic plastic material for encapsulating the module.

The encapsulated module has opposite, flattened surfaces. Even the light sources, which are preferably light emitting diodes, have electrodes that are flush-mounted with the flattened surfaces of the module, and thus do not provide any raised points which might serve as a source of discomfort when placed adjacent the wearer's body. The encapsulated module is a generally planar disk which does not cause wearer discomfort.

In accordance with this invention, the flashing lights create an eye-catching display whether the stocking is worn by day or by night. In addition, the flashing lights enhance the wearer's safety, especially at night, since the wearer's stockinged feet are more visible. Still further, many wearers don stockings to bed and, should such wearers walk at night in their stockinged feet, then the lights serve as a nightlight to guide their way in the dark.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
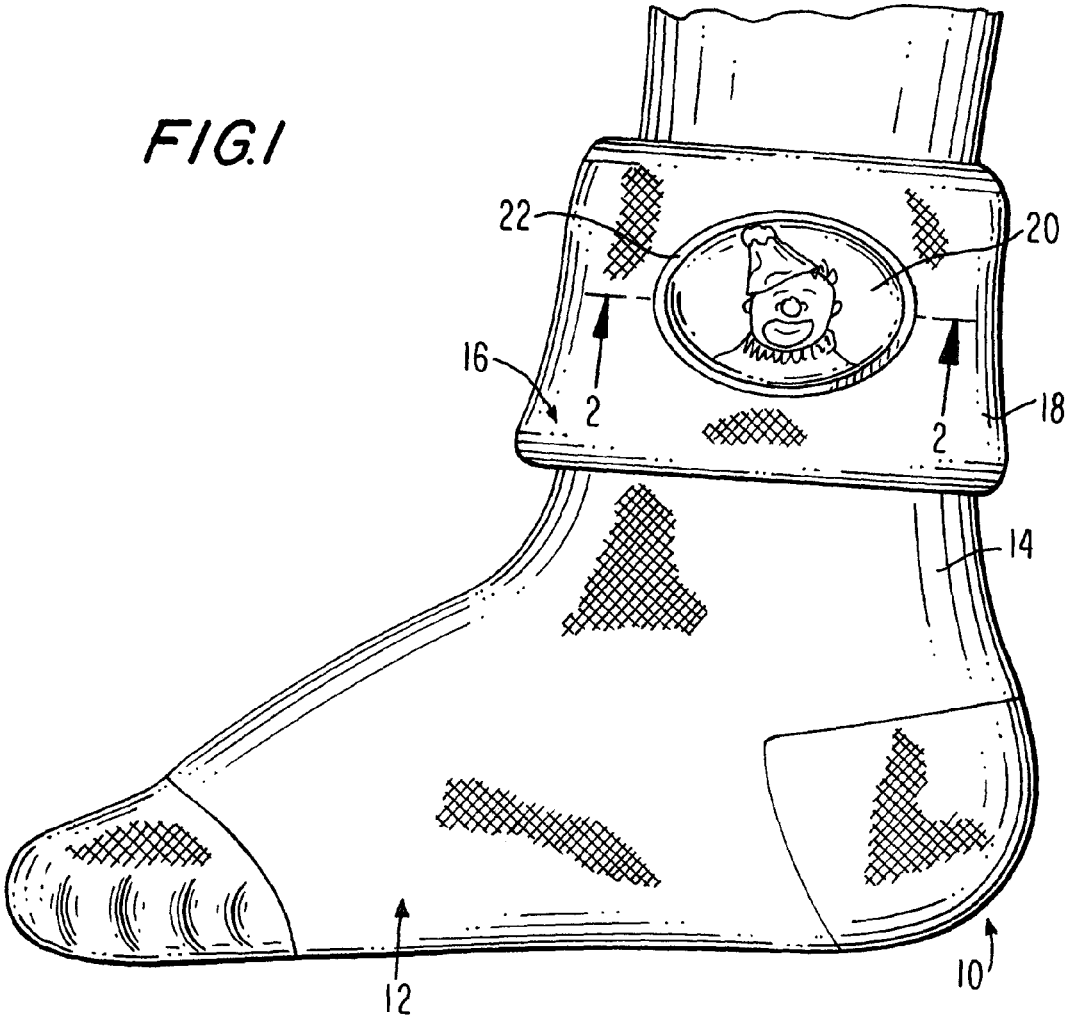
FIG. 1 is a front elevational view of a stocking in accordance with this invention.

Referring now to the drawings, reference numeral 10 generally identifies a stocking or sock, one of a matched pair, to be worn either with or without shoes. Sock 10 includes a foot portion 12 closely fitted around the wearer's foot, a leg portion 14 closely fitted around a lower part of the wearer's leg, especially around the ankle, and an end portion 16 having an open end through which the wearer's foot is inserted upon donning the sock. The foot portion 12 may be opened or closed at the wearer's toes. The foot portion 12 has a floor-engaging surface on which treads may be fused to enhance the use of the stocking without a shoe.

As shown in FIG. 1, the end portion 16 is folded down over the leg portion 14 to form an annular cuff 18, primarily for fashion reasons, and for this purpose, the lower end of the cuff 18 may be scalloped, or provided with a piping of a contrasting color, or the cuff itself may be made with material of a contrasting color. The sock itself is preferably knitted of yarn selected from such materials as cotton, wool, nylon or silk.

Figure 2:
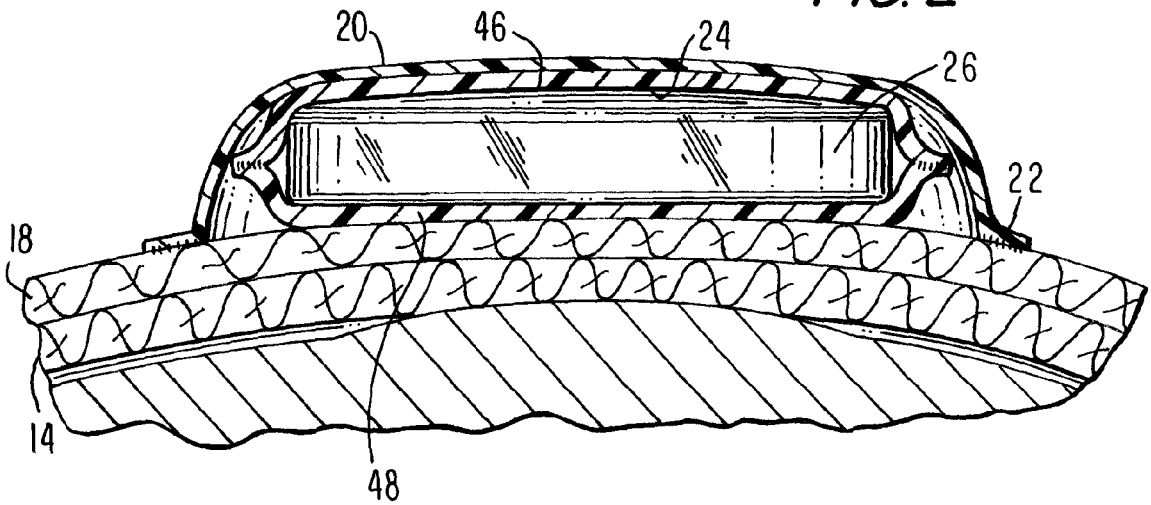
FIG. 2 is an enlarged sectional view taken on line 2-2 of FIG. 1.

An overlay 20 is attached to the sock, especially on the cuff 18. The overlay 20 is fused to the cuff along a heat-fused seal 22 that extends around the entire periphery of the overlay. The overlay is constituted of a soft, flexible, light-transmissive material, such as rubber or plastic, and is preferably molded with a graphic, such as the illustrated three-dimensional cat face, thereon. The overlay forms a compartment 24, as best seen in the sectional view of FIG. 2, with the cuff.

Figure 4:
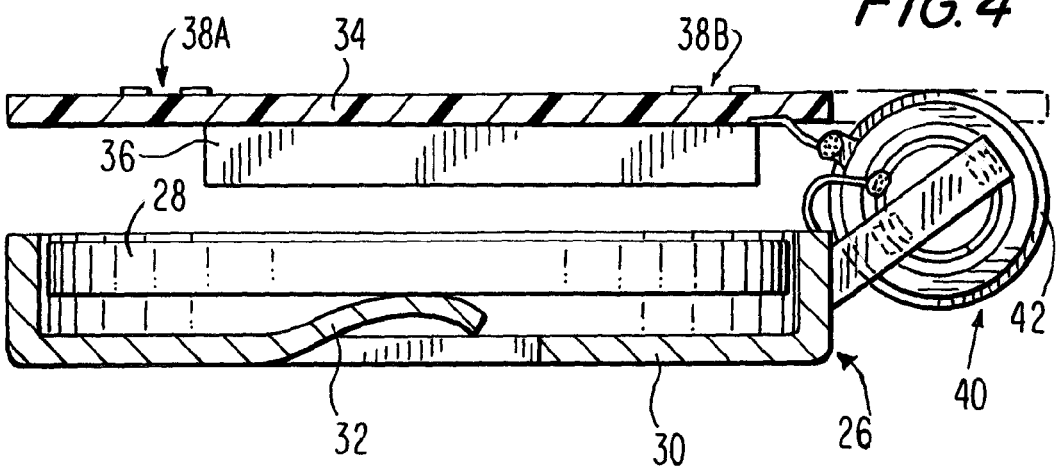
FIG. 4 is an exploded view of the lighting module prior to assembly and encapsulation.
Figure 5:
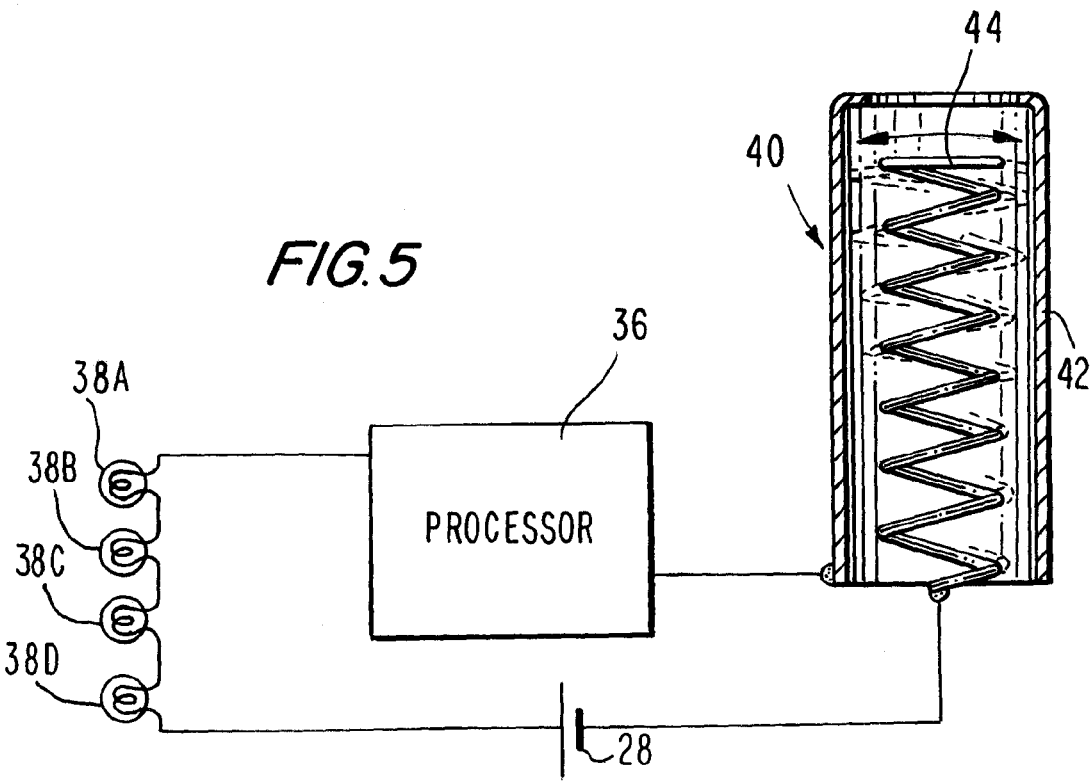
FIG. 5 is an electrical schematic of a circuit used in the lighting module of FIG. 3.

A lighting module 26 is received and held in the compartment 24. As best seen in the exploded view of FIG. 4, the module 26 includes a battery 28, typically a flat circular disk battery commonly used in cameras, a battery holder 30 having a resilient finger 32 for engaging one side of the battery, a planar support such as a printed circuit board 34, a processor 36 mounted on the board 34, at least one light source and preferably a plurality of light sources 38A, B, C, D also mounted on the board 34, and a motion-responsive switch 40 electrically connected to the processor 36, the battery 28, and the light sources 38A, B, C, D in the manner illustrated in the circuit of FIG. 5.

The switch 40 includes an electrically conductive outer sleeve 42 in which an electrically conductive coil spring 44 is mounted for movement between an open position in which the spring is located out of physical conductive contact with the sleeve 42, and a closed position in which the spring contacts the sleeve 42. Motion of the spring is caused by movement of the wearer and, to aid such spring motion, the free end of the cantilevered spring 44 can be weighted.

In the closed position of the switch 40, the processor is energized by the battery and causes the light sources to emit light, preferably flashes of light in a pattern determined by the processor. The pattern may be predetermined or random. The flashing can occur immediately when the closed position is reached, or after a time delay. The flashing is terminated after a predetermined time, or after a randomly chosen time interval. Continuous illumination is contemplated, but not preferred to minimize power consumption.

The light sources are light emitting diodes operative for emitting light of the same or different colors. Each diode includes a pair of planar electrodes, as best seen in FIG. 3, which are flush-mounted on an exterior planar surface of the board 34.

Figure 3:
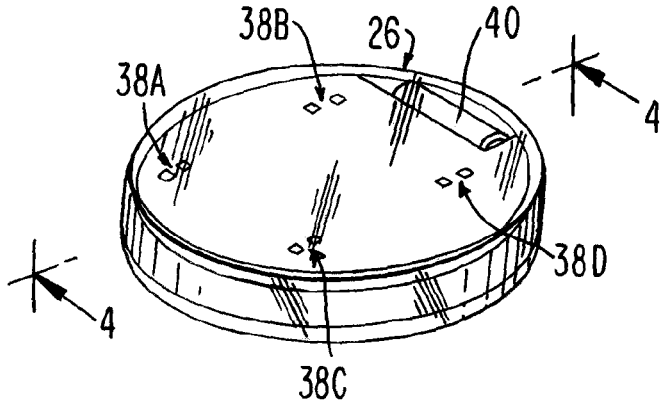
FIG. 3 is a perspective view of an encapsulated lighting module for use with this invention.

As best seen in FIG. 3, the module 26 is encapsulated in a synthetic plastic material which is preferably light-transmissive. The encapsulated module has smooth, flattened major surfaces and has a circular or ovoidal disk shape. All of the components of the module are potted inside the encapsulated plastic, and there are no exposed rough edges. The encapsulating plastic was not shown in FIG. 4 so as not to encumber this drawing.

Water is prevented from entering and damaging the module by the aforementioned seal 20, by the aforementioned encapsulating plastic, and by an envelope comprised of juxtaposed plastic sheets 46, 48 (see FIG. 2) which are sealed about their periphery and which sandwich the module therebetween.

In use, the module is mounted on an exterior surface of the cuff 18 and is positioned away from the wearer's leg. Even if a force presses the module against the wearer's leg, there is no discomfort, because the module has no exposed rough edges and is cushioned by the material of the sock. As the wearer moves, the light emitted by the module passes through the light-transmissive encapsulating plastic, the light-transmissive envelope, and the light transmissive overlay and illuminates the graphic thereon. If the wearer does not wish the lights to be visible, then the cuff is unfolded such that the overlay faces the wearer's leg. Again, there is no discomfort, because the overlay and the module have no exposed rough edges.

It will be understood that each of the elements described above, or two or more together, also may find a useful application in other types of constructions differing from the types described above.

While the invention has been illustrated and described as embodied in a motion-responsive illuminated stocking, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A motion-responsive illuminated stocking, comprising:

a covering having a foot portion closely fitted on and around, and entirely covering, a foot of a wearer;

a lighting module attached to the covering, for emitting light in response to motion by a wearer of the covering, the module including a battery for supplying electrical power, an energizable light source and a motion-responsive switch for connecting the battery to the light source to energize the latter to emit the light; and means for resisting entry of water into the module.

2. The stocking of claim 1, wherein the resisting means includes a sealed envelope in which the module is sealingly contained.

3. The stocking of claim 1, wherein the resisting means is a synthetic plastic, light-transmissive, material for encapsulating the battery and the light source.

4. The stocking of claim 1, wherein the covering is made of a material selected from a group consisting of cotton, wool, silk, and nylon.

5. The stocking of claim 1, wherein the lighting module includes a processor for flashing the light source when the battery is connected to the light source by the motion-responsive switch.

6. The stocking of claim 5, wherein additional light sources are operatively connected to the processor for flashing all the light sources in a pattern.

7. The stocking of claim 1, wherein the motion-responsive switch includes a coil spring mounted within a sleeve for movement between an open position in which the spring is spaced from the sleeve, to a closed position in which the spring contacts the sleeve.

8. The stocking of claim 1, wherein the lighting module includes a planar support, and wherein the light source has planar electrodes mounted flush with the planar support.

9. The stocking of claim 2, wherein the envelope is constituted of a flexible, light-transmissive material.

10. The stocking of claim 1, wherein the module is a disk having rounded corners.

11. The stocking of claim 1, and a flexible overlay having a periphery entirely connected to the covering and bounding a compartment in which the module is received and permanently held, the overlay being transmissive to the light emitted by the light source.

12. The stocking of claim 1, and a graphic illuminated by the emitted light.

13. The stocking of claim 11, and a graphic on the overlay and illuminated by the emitted light.

14. The stocking of claim 1, wherein the light source includes at least one light emitting diode.

15. The stocking of claim 11, and a heat-fused seal extending around the periphery of the overlay and sealing the overlay to the stocking.

16. The stocking of claim 11, wherein the covering has a leg portion closely fitted around a part of a leg of the wearer, and wherein the overlay is attached to the leg portion of the covering.

17. The stocking of claim 16, wherein the leg portion includes an end portion on which the overlay is attached, the end portion being foldable to a folded position to form an annular cuff on which the overlay is exteriorly viewable, and the end portion being unfolded to an unfolded position in which the overlay is concealed from view.

18. A motion-responsive illuminated stocking, comprising:

a covering having a foot portion closely fitted on and around, and entirely covering, a foot of a wearer;

a lighting module attached to the covering, for emitting light in response to motion by a wearer of the stocking, the module including a battery for supplying electrical power, an energizable light source and a motion-responsive switch for connecting the battery to the light source to energize the latter to emit the light;

a graphic illuminated by the emitted light; and means for resisting entry of water into the module.

19. A motion-responsive illuminated stocking, comprising:

a covering having a foot portion closely fitted on and around, and entirely covering, a foot of a wearer;

a lighting module attached to the covering, for emitting light in response to motion by a wearer of the stocking, the module including a battery for supplying electrical power, an energizable light source and a motion-responsive switch for connecting the battery to the light source to energize the latter to emit the light;

a flexible support overlying the module and having a periphery entirely connected to the covering to support the module on the stocking;

a graphic on the support and being illuminated by the emitted light; and means for resisting entry of water into the module.

* * * * *